US006626314B1

(12) United States Patent
McHenry et al.

(10) Patent No.: US 6,626,314 B1
(45) Date of Patent: Sep. 30, 2003

(54) RESEALABLE CLOSURE FOR BEVERAGE CONTAINER

(75) Inventors: Robert J. McHenry, St. Charles, IL (US); Thomas Tung, Barrington, IL (US)

(73) Assignee: Rexam Beverage Can Company, Chicago, IL (US)

( * ) Notice: Subject to any disclaimer, the term of this patent is extended or adjusted under 35 U.S.C. 154(b) by 88 days.

(21) Appl. No.: 09/804,257

(22) Filed: Mar. 13, 2001

(51) Int. Cl.[7] ..... B65D 51/18

(52) U.S. Cl. ..... 220/254.2; 220/254.3; 220/254.4; 220/255; 220/822; 220/826; 222/516; 222/517; 222/556; 222/557

(58) Field of Search ..... 220/254.4, 254.5, 220/255, 257.1, 259.1, 259.5, 259.4, 820, 821, 822, 823, 824, 263, 264, 254.6, 254.2, 826, 259.2, 254.3; 222/557, 555, 516, 517, 548, 556

(56) References Cited

U.S. PATENT DOCUMENTS

| | | | | | |
|---|---|---|---|---|---|
| 1,281,472 | A | * | 10/1918 | Wooten | 222/557 |
| 2,105,445 | A | | 1/1938 | Sebell | |
| 2,173,571 | A | | 9/1939 | Jesnig | |
| 2,224,296 | A | | 12/1940 | Hoffman | |
| 2,302,972 | A | * | 11/1942 | Nuckols | 222/517 |
| 2,322,236 | A | | 6/1943 | Ingram | |
| 2,429,984 | A | | 11/1947 | Berglund | |
| 2,690,852 | A | * | 10/1954 | Schuler | 222/482 |
| 2,986,310 | A | * | 5/1961 | Spaulding | 222/481.5 |
| 3,447,724 | A | | 6/1969 | Fiddyment | |
| 3,717,276 | A | | 2/1973 | Luczak et al. | |
| 3,938,690 | A | | 2/1976 | Butler | |
| 4,023,703 | A | | 5/1977 | Strobe et al. | |
| 4,077,538 | A | | 3/1978 | Waterbury | |
| 4,078,702 | A | * | 3/1978 | Neff | 222/557 |
| 4,099,642 | A | * | 7/1978 | Nergard | 220/254.5 |
| 4,127,212 | A | | 11/1978 | Waterbury | |
| 4,136,797 | A | | 1/1979 | Potts | |
| 4,170,724 | A | | 10/1979 | Waterbury | |
| 4,171,060 | A | * | 10/1979 | Howard et al. | 220/254.4 |
| 4,183,443 | A | | 1/1980 | DeParales et al. | |
| 4,234,099 | A | | 11/1980 | Tarro | |
| 4,339,053 | A | | 7/1982 | Tarro | |
| 4,361,249 | A | | 11/1982 | Tuneski et al. | |
| 4,433,792 | A | | 2/1984 | Mandel | |
| 4,442,950 | A | | 4/1984 | Wilson | |
| 4,463,866 | A | | 8/1984 | Mandel | |
| 4,489,018 | A | | 12/1984 | Ball | |
| 4,506,809 | A | | 3/1985 | Corsette | |
| 4,541,541 | A | | 9/1985 | Hickman et al. | |
| 4,572,398 | A | | 2/1986 | Juty | |
| 4,576,306 | A | | 3/1986 | Kelsey et al. | |
| 4,580,692 | A | | 4/1986 | LaBarge et al. | |
| 4,605,141 | A | | 8/1986 | Won | |

(List continued on next page.)

FOREIGN PATENT DOCUMENTS

| | | | |
|---|---|---|---|
| CA | 1106799 | | 8/1981 |
| DE | 4200614 | | 3/1993 |
| GB | 2342341 | * | 4/2000 |
| WO | WO 94/24006 | | 10/1994 |

*Primary Examiner*—Nathan J. Newhouse
(74) *Attorney, Agent, or Firm*—Marshall, Gerstein & Borun LLP

(57) ABSTRACT

A resealable closure for beverage containers uses initial physical interference to initiate a seal between a sealing flap and a dispensing port in a lid of the resealable closure. Once the initial seal is achieved, a pressure differential develops, resulting in additional force tending to bias the sealing flap toward the dispensing port. The sealing flap is actuated by an external drive means, that can also be a dust cover to prevent debris from contaminating any surfaces that may come into contact with the contents of the beverage container. There is a slack between initial movement of the external drive means and initial movement of the sealing flap, during which the pressure differential is preferably equalized through the unsealing of a vent hole in the resealable closure.

26 Claims, 7 Drawing Sheets

U.S. PATENT DOCUMENTS

| | | | | |
|---|---|---|---|---|
| 4,632,271 | A | | 12/1986 | Taylor et al. |
| 4,673,099 | A | | 6/1987 | Wells |
| 4,681,238 | A | | 7/1987 | Sanchez |
| 4,685,849 | A | | 8/1987 | LaBarge et al. |
| 4,711,363 | A | | 12/1987 | Marino |
| 4,711,372 | A | | 12/1987 | Gach |
| 4,720,022 | A | | 1/1988 | Gomes |
| 4,735,336 | A | | 4/1988 | Buchner et al. |
| 4,746,032 | A | | 5/1988 | Huang |
| 4,747,511 | A | | 5/1988 | Dutt et al. |
| 4,792,054 | A | | 12/1988 | Weidman |
| 4,821,912 | A | | 4/1989 | Wells |
| 4,834,258 | A | | 5/1989 | Root |
| 4,842,159 | A | | 6/1989 | Heidrich |
| 4,865,215 | A | | 9/1989 | Wells |
| 4,880,137 | A | | 11/1989 | Wells |
| 5,080,249 | A | | 1/1992 | Shock |
| 5,135,124 | A | | 8/1992 | Wobser |
| 5,143,248 | A | | 9/1992 | Sawatsky |
| 5,148,936 | A | | 9/1992 | DeGrow |
| 5,205,430 | A | | 4/1993 | Valyi |
| 5,232,113 | A | | 8/1993 | Chen-Tsai et al. |
| 5,242,073 | A | | 9/1993 | Willis et al. |
| 5,242,079 | A | | 9/1993 | Stephens et al. |
| 5,251,770 | A | | 10/1993 | Bartley et al. |
| 5,285,924 | A | | 2/1994 | Morris |
| 5,363,978 | A | | 11/1994 | Molo |
| 5,443,175 | A | | 8/1995 | Kelly et al. |
| 5,555,993 | A | | 9/1996 | Borkowski et al. |
| 5,637,104 | A | | 6/1997 | Ball et al. |
| 5,810,189 | A | | 9/1998 | Baker |
| 5,813,559 | A | | 9/1998 | Cho |
| 5,893,489 | A | * | 4/1999 | Giarrante ..... 222/482 |
| 6,010,029 | A | * | 1/2000 | Wang ..... 220/254.4 |
| 6,015,054 | A | | 1/2000 | King et al. |
| 6,098,834 | A | * | 8/2000 | Hatsumoto et al. ..... 220/254.5 |
| 6,158,608 | A | | 12/2000 | Schlattl |

* cited by examiner

FIG. 16
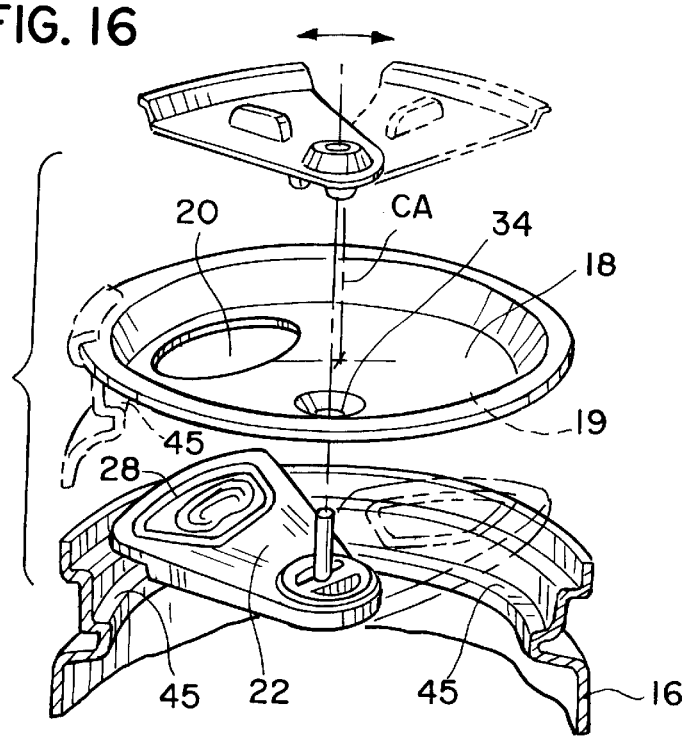
FIG. 17
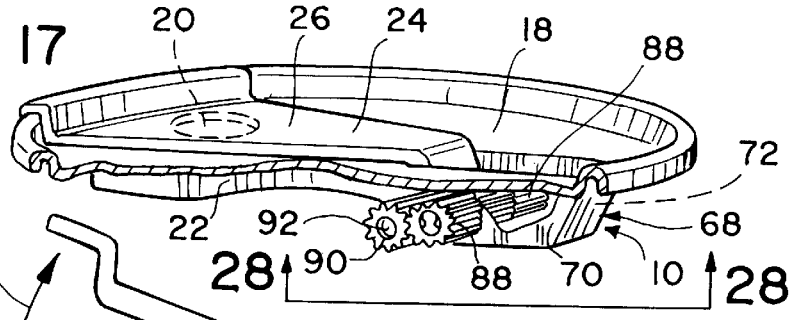
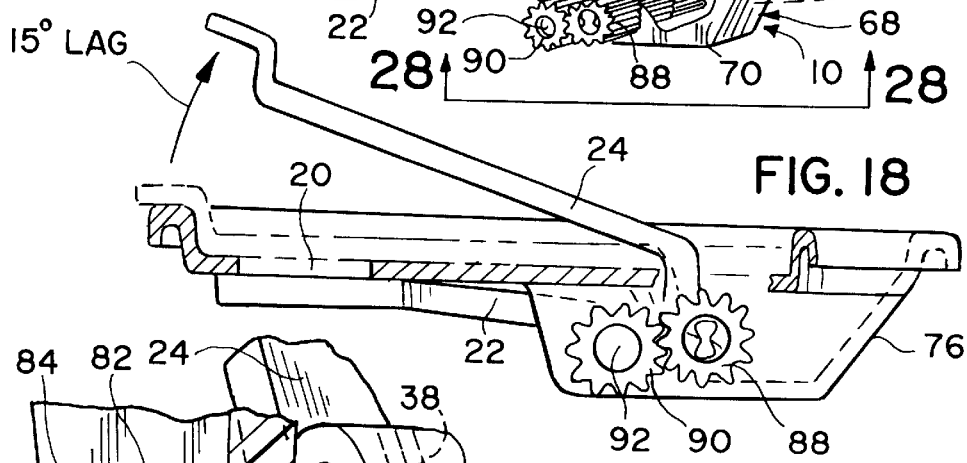
FIG. 18
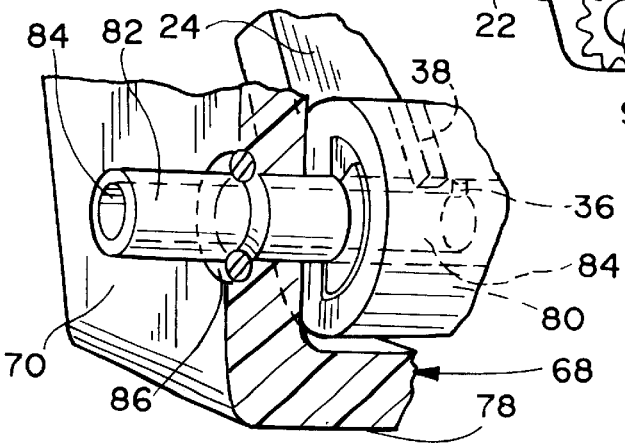
FIG. 19

RESEALABLE CLOSURE FOR BEVERAGE CONTAINER

BACKGROUND

1. Field of the Invention

This invention relates generally to resealable closures for beverage containers and, more specifically, to resealable closures that utilize a combination of initial mechanical interference and internal pressure to achieve and maintain a tight, reliable seal of a dispensing port of a beverage container.

2. Description of the Prior Art

Many inventions have been proposed to reseal a carbonated beverage container in order that a portion of the contents can be saved for a later time. In the case of beverage cans, most of these inventions have proposed using a variation on a bottle cork; i.e., they involve inserting some kind of stopper into the dispensing port created by pushing in a scored portion of the metal end at the time of initial opening. None of these inventions have been commercially successful. The problem is that the carbonated beverage will emit a gas that exerts a force in the direction to dislodge the stopper from the opening. On a hot day, the pressure could exert a force of between forty and fifty pounds. If the stopper is jammed into the opening with sufficient mechanical interference to resist such a high force, it will not be possible for the average consumer to remove the stopper at normal use temperatures. In the design of conventional easy-open metal can ends, it is assumed that the consumer can exert a force no larger than 8 pounds.

In co-owned U.S. patent application Ser. No. 08/953,067, now U.S. Pat. No. 6,220,470, a resealable closure is described that uses a sliding flap to unseal and later reseal the dispensing port of a container. This invention avoids the above problem by using a sliding motion that is nearly perpendicular to the primary vertical force generated by the internal pressure. There are two basic limitations with this design. The first is that, because of the creep tendencies of the plastic materials most suitable for such flaps, the flaps must be fairly thick in order to resist the forces generated by the internal pressure. The second is that the internal pressure creates a high friction force that resists the sliding of the flap.

The resealability problem has been solved for narrow neck bottles through the use of threaded bottle caps. Because of the mechanical advantage presented by the shallow angle of the threads, a moderate twisting force suffices to remove a cap that is strong enough to resist high internal pressures. With wider neck bottles, this type of closure is less successful. Although the same mechanical advantage principles apply, the force exerted by the gas pressure within the bottle is much higher. At a high beverage pressure, therefore, the friction force resisting the turning of the cap will be uncomfortably high. It is also well known that a threaded or lug closure on a wide mouth jar subjected to an external pressure (i.e. internal vacuum) can also be extremely difficult to open.

To reduce this friction force, it would be desirable to have a means to vent the pressure in the can or bottle prior to opening. There have been several inventions to achieve venting of the net internal pressure before full opening of a closure. Unfortunately, most of these inventions achieve the venting through the initial rotation of the closure. Such a venting means during the course of the rotation prevents a sudden and, possibly, dangerous missiling of the closure when the threads on the closure eventually clear those on the container. Because the closure must be rotated in order to vent the pressure, these designs cannot aid in reducing the force required for initial rotation.

It would be possible to provide a separate, small plug that would initially cover a venting port (for purposes of this disclosure, a venting port means a hole or other means of communication between the inside of the container and the outside environment.). This would require the consumer first to remove this small venting plug and then, in a separate action, remove the component that seals the dispensing port. It would be more desirable if the same action that initially vents the can could, when continued, open the dispensing port.

With current easy-open ends for metal beverage cans, one can vent and then open the end with the same lifting motion. In the initial portion of this venting, a small vent crack is created by fracturing a scored line in the panel. Unfortunately, this form of venting is non-reversible. Even if there were to be a means to reseal the main dispensing port, gas and liquid could still escape through this vent crack.

SUMMARY OF THE INVENTION

In each of the various embodiments of the present invention, a sealing flap is used to block a dispensing port of a beverage container in such a way that a pressure differential, i.e. the difference between the internal pressure of a beverage container and the surrounding atmosphere, enhances a seal of the dispensing port. For example, when the sealing flap is situated inside the container, i.e., under the lid of the container, and a sealing gasket is provided between the sealing flap and the perimeter of the dispensing port on the underside of the lid, the internal pressure of the container assists in forcing the sealing flap into a sealed engagement with the perimeter of the dispensing port.

In the embodiments of the present invention, it is desirable to use some type of physical interference to force the sealing flap into sealed engagement with the perimeter of the dispensing port. Once the sealing force is initiated by some type of physical interference, the carbonation within the beverage will gradually escape from the beverage and fill the head space beneath the lid, resulting in a build up of internal pressure. This creates a gradually increasing pressure differential, which enhances the seal between the sealing flap and the perimeter of the dispensing port. While it is recognized that the principles of the present invention can be applied to containers for non-carbonated beverages, and even to vacuum-packaged beverage and food containers, a particularly useful application of the present invention is for pressurized beverage containers, which are typically carbonated drinks.

In order to avoid exposing the surfaces that will contact the beverage or the consumer's mouth to debris, it is also desirable to provide a movable dust cover on the outside, i.e., top, of the lid. Many of the embodiments of the present invention include such a dust cover. Advantageously, the external drive means of the resealable closure of the present invention provides a means to actuate the sealing flap between a sealed and an unsealed position, and also serves as the dust cover. It is also recognized that it would be advantageous to vent internal pressure of the beverage container prior to unsealing the dispensing port. This is because the internal pressure increases the force, including the friction force between the sealing flap and the perimeter of the dispensing port of the container lid, as well as between the sealing flap and other points of contact with the container. Once the internal pressure of the beverage container is vented, these resulting forces are substantially reduced, making it much easier to unseal the dispensing port.

A particular advantage of the present invention is that the forces necessary to initially vent the pressure in order to generally equalize the internal pressure with the surrounding atmospheric pressure are much lower in the various embodiments now disclosed, as compared to many conventional beverage containers, including bottles, because with these new resealable closures, venting is achieved prior to initial movement of the sealing flap. A further advantage is that any relatively high forces that must be exerted by a user on the external drive means in order to overcome the initial mechanical interference that had been used used to initiate the seal between the sealing flap and the perimeter of the dispensing port on the underside of the lid need only be exerted for a relatively short interval of time. This is an important improvement over beverage container lids that would require the user to exert high forces throughout the entire duration of travel of the drive means to overcome forces from mechanical interference.

In order to be able to achieve repeated re-sealing and re-opening of the dispensing port, and retain adequate pressure within the beverage container after re-sealing so that carbonated beverages will still be carbonated after being left to sit for extended periods of time, it is necessary not only to re-seal the dispensing port, but also to re-seal any venting means that are used to initially vent the internal pressure of the beverage container. In fact, if the vent is not re-sealed, liquid product could also flow through the vent when the container is resting on its side. While re-sealing of the venting means may take place after re-sealing of the dispensing port, it is most desirable if the venting means is re-sealed prior to, or at least during, re-sealing of the dispensing port, so that a user does not forget to re-seal the vent once the dispensing port is re-sealed. Alternatively, in embodiments where the venting means is closed subsequent to re-sealing of the dispensing port, it is desirable to provide a tactile and/or audible reminder that activates upon re-sealing of the venting means, such that a user is assured both the dispensing port and the venting means are re-sealed. The manner in which these and other features of the present invention are accomplished is explained in greater detail in the following Detailed Description of the Preferred Embodiments and the accompanying drawings.

BRIEF DESCRIPTION OF THE SEVERAL VIEWS OF THE DRAWING

FIG. 16 is an exploded view of a modified version of the fourth embodiment of the resealable closure for beverage containers of the present invention;

FIG. 17 is a perspective view, cut away, of a fifth embodiment of the resealable closure for beverage containers of the present invention with the external drive means in its initial position, and wherein both the dispensing port of the beverage container and the vent are sealed;

FIG. 18 is a left side view, partially broken away, of the resealable closure for beverage containers shown in FIG. 17, with the external drive means moved to an intermediate position, wherein the vent of the resealable closure is unsealed and the dispensing port of the beverage container is still sealed;

FIG. 19 is an enlarged view, broken away, of an exemplary venting mechanism for the resealable closure for beverage containers shown in FIG. 17;

DETAILED DESCRIPTION OF THE PREFERRED EMBODIMENTS

Figure 1:
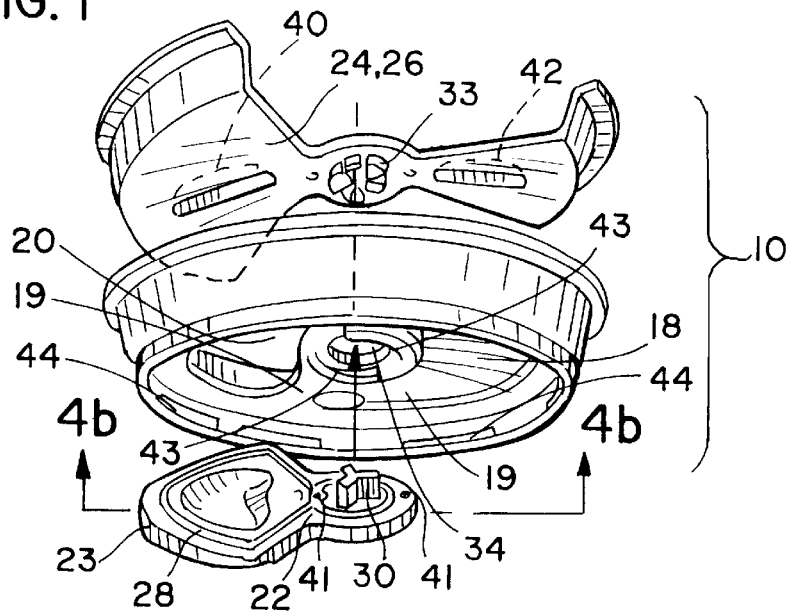
FIG. 1 is an exploded view of a first embodiment of the resealable closure for beverage containers of the present invention.

In a first embodiment of the present invention, shown in FIGS. 1–8, a resealable closure 10 for a beverage container 12 having a bottom 14, a sidewall 16, and a top panel or lid 18 having a dispensing port 20, includes a sealing flap 22 and an external drive means 24 taking the form of a dust cover 26. The terms "dust cover 26" and "external drive means 24" are used interchangeably throughout this disclosure, although it should be appreciated that the external drive means does not also have to be capable of providing protection from debris. In this embodiment, both the sealing flap 22 and the dust cover 26 slide in planes generally parallel to the lid 18. As explained in greater detail below, however, the present invention is not limited to sealing flaps and drive means that slide in planes generally parallel to the lid, but also includes sealing flaps and drive means that move in other planes as well.

Advantageously, a sealing surface is provided between the sealing flap 22 and the perimeter of the dispensing port 20. The sealing surface may take the form of a separate sealing gasket 28. Alternatively, the sealing flap 22 may be made of a sufficiently resilient material to obviate the need for a sealing gasket 28. The sealing gasket 28 is preferably made of resilient materials, such as ethylene-vinyl acetate copolymer resins or acid-modified ethylene-acrylate. While it is recognized that the sealing gasket 28 can be attached either to the perimeter of the dispensing port on the underside 19 of the lid 18 or to the upper surface of the sealing flap 22, it is preferable, for manufacturing considerations, that the sealing gasket 28 be attached to the upper surface of the sealing flap 22.

Figure 2:
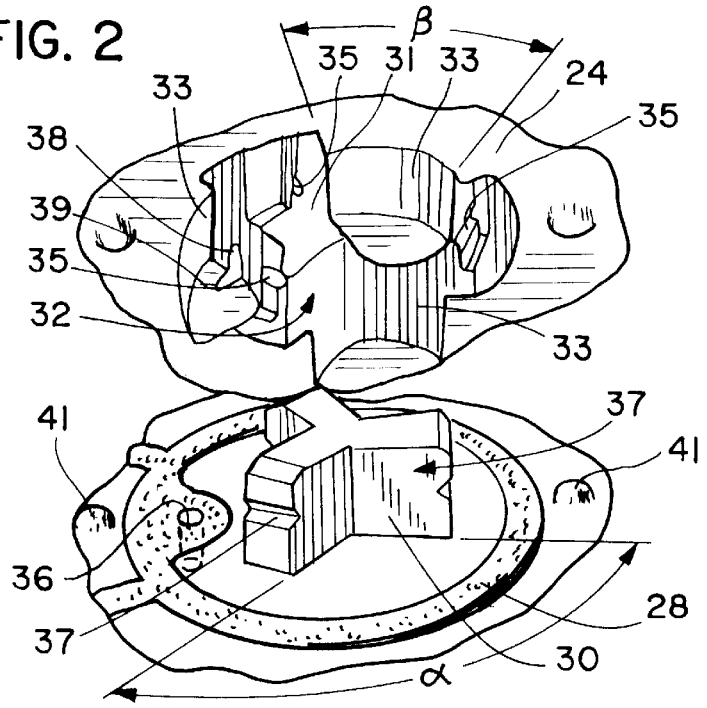
FIG. 2 is an enlarged exploded view of the interconnection between the external drive means and the sealing flap of the resealable closure shown in FIG. 1.

As best shown in FIG. 2, communication between the sealing flap 22 and the external drive means 24 is achieved in this first embodiment by a plurality of upwardly-directed projections 30 of the sealing flap 22, received in an aperture 31 of a socket 32 defined by projection-engaging members 33, preferably integral with, and extending downwardly from, the dust cover 24 through a hole 34 in the lid 18. Rib members 35 may also be provided on the underside of the dust cover 26 to slidably engage generally horizontal grooves 37 provided in the outermost sidewalls of the projections 30 to lock the sealing flap 22 and external drive means 24 into a constant vertical relationship with one another, at least while the external drive means 24 is causing movement of the sealing flap 22. As explained in greater detail below, it is advantageous to maintain a constant vertical relationship between the sealing flap 22 and the external drive means 24 during movement of the sealing flap 22 in the embodiments where both move generally in the plane of the lid 18, in order to avoid tilting or cocking of either the sealing flap 22 or the dust cover 26 during opening or re-closing of the beverage container 12.

Before unsealing the sealing flap 22, it is highly desirable that the internal pressure of the beverage container 12 be generally equalized with the surrounding atmosphere. Otherwise, friction between the underside 19 of the lid 18 and the sealing flap 22 or other forces caused by the pressure differential could be too high for many users to overcome with a reasonable amount of effort. Venting of the internal pressure is accomplished by venting means, which preferably takes the form of a pressure equalization port, or vent hole 36. The vent hole 36 may be provided in the sealing flap 22, or, alternatively, may take the form of a selectively unsealable hole (not shown) in the lid 18 that is covered by at least a portion of the dust cover 26. Some type of venting channel 38 is also preferably provided in a portion of the dust cover 26.

Figure 4A:
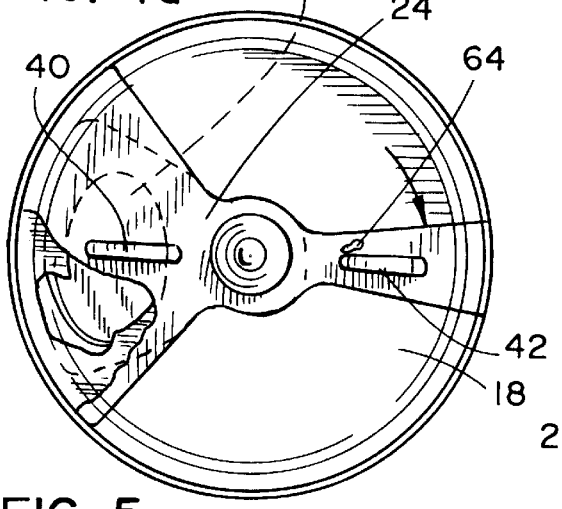
FIG. 4*a* is a top view of the resealable closure shown in FIG. 1, with the external drive means in its initial position, and wherein both the dispensing port of the beverage container and the vent are sealed.
Figure 4B:
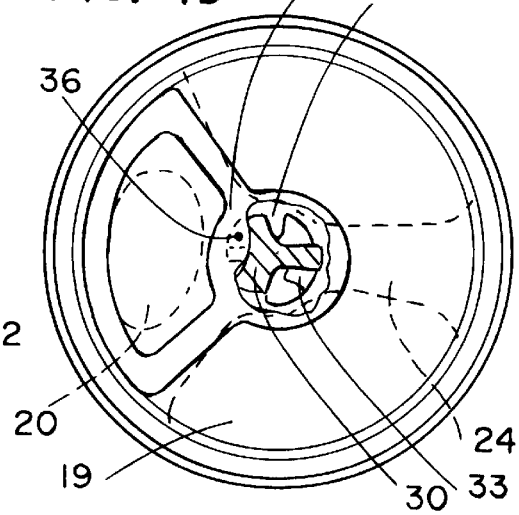
FIG. 4*b* is a bottom view of the resealable closure shown in FIG. 1, showing the resealable closure at the same instant in time as FIG. 4*a*, and taken along lines 4*b*—4*b* of FIG. 1, in which the sealing flap is in its initial position.

When the dust cover 26 is in the initial closed position shown in FIGS. 4*a* and 4*b*, a bottom surface 39 of one of the projection-engaging members 33 initially tightly covers the vent hole 36. As the dust cover 24 is moved a small amount from its initial position to an intermediate position, shown in FIGS. 5*a* and 5*b*, the bottom surface 39 of the projection engaging member 33 uncovers the vent hole 36, quickly allowing the vent hole 36 to communicate with the venting channel 38, and allowing internal pressure of the beverage container 12 to equalize with atmospheric pressure. As a result, the friction between the sealing flap 22, the sealing gasket 28 and the underside 19 of the lid 18 is reduced to a level that allows movement of the sealing flap 22 with only a reasonable degree of effort applied by a user to the dust cover 26. In a preferable resealable closure of the present invention, the dust cover 24 is moved approximately 15° from the initial position shown in FIG. 4*a* to the intermediate position shown in FIG. 5*a*.

Importantly, movement of the dust cover 26 does not immediately result in movement of the sealing flap 22. Instead, there is a delay, or dwell period, caused by a slack between initial movement of the dust cover 26 and initial movement of the sealing flap 22. This slack may be provided by making the differences between respective angles, such as $\alpha$ and $\beta$, between the surfaces of the elements that engage one another to initiate driving motion of the sealing flap 22, sufficient to allow venting to occur prior to motion of the sealing flap 22. Preferably, in the embodiment shown in FIG. 9, this slack allows for approximately 15° of relative motion of the dust cover 26 to allow venting prior to movement of the sealing flap 22. Also, upon re-closing of the resealable closure 10, the slack allows the vent hole 36 to be re-sealed prior to movement of the sealing flap 22 back toward its initial closed position underneath the dispensing port.

Figure 6A:
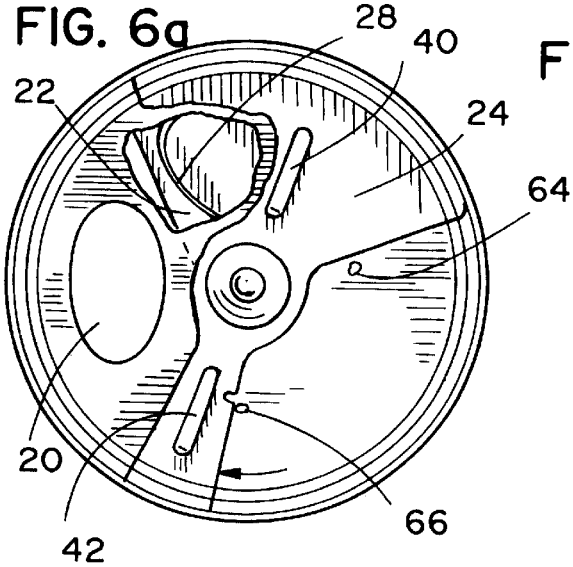
FIG. 6*a* is a top view of the resealable closure shown in FIG. 1, with the external drive means moved to a final position, wherein the vent of the resealable closure is unsealed and the dispensing port of the beverage container is unsealed.
Figure 6B:
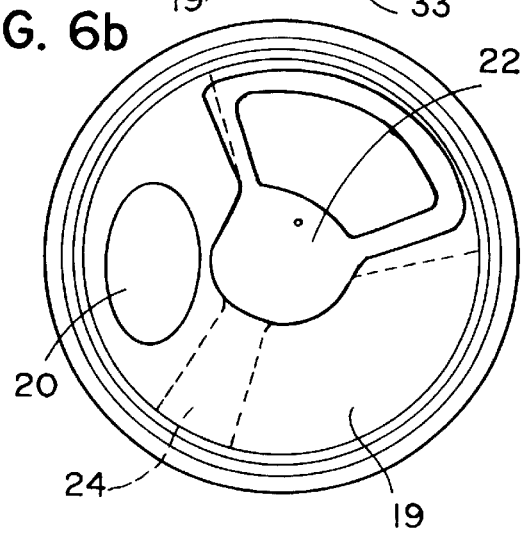
FIG. 6*b* is a bottom view of the resealable closure shown in FIG. 1, showing the resealable closure at the same instant in time as FIG. 6*a*, with the sealing flap having been moved to its final position.
Figure 7:
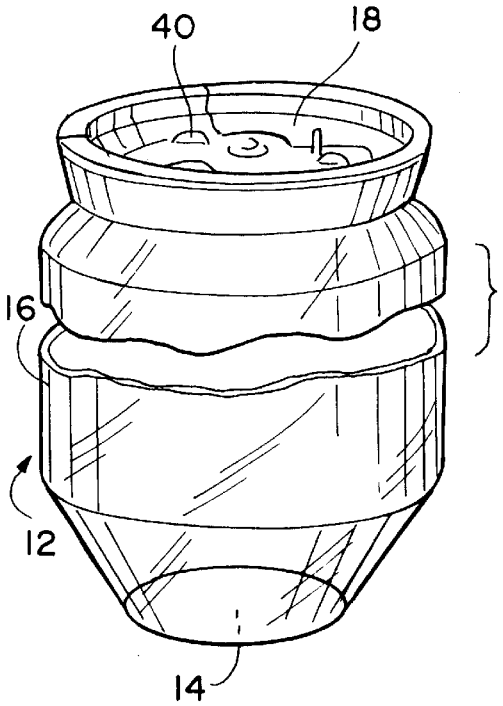
FIG. 7 is a perspective view, broken away, of a plastic beverage container having a resealable closure of the type shown in FIG. 1.

Once one of the projection engaging members 33 contacts the radial wall of one of the projections 30, further movement (in this embodiment, rotation) of the external drive means 24 results in corresponding motion of the sealing flap 22, thereby opening the dispensing port 20, as shown in FIGS. 6*a* and 6*b*.

Prior to unsealing the vent hole 36, forces from the internal pressure of the beverage container 12 help to keep the vent hole 36 sealed, by biasing the projection 30 toward the bottom surface 39 of the projection engaging member 30, at a position where the venting channel 38 and the vent hole 36 are out of communication because the vent hole 36 is covered, whereby the bottom surface 39 prevents gases from passing through the vent hole.

That the slack allows for a delay between initial movement of the dust cover 26 and initial movement of the sealing flap 22 not only before opening of the dispensing port 20, but also prior to closing of the dispensing port, is particularly advantageous because it allows re-sealing of the vent hole 36 a passive procedure, so the user will not forget to reseal the vent after re-closing the dispensing port 20, undesirably allowing all the carbonation to be lost. During this reversed slack period, i.e. prior to closing of the dispensing port, the vent hole 36 is covered by the bottom surface 39 of one of the projection engaging members 30, thereby re-sealing the vent. Thereafter, continued sliding movement of the external drive means 24 results in re-sealing of the dispensing port 20 in the lid 18 by returning the sealing flap 22 to its initial position. Alternatively, it is possible for the resealable closure of the present invention to be of such a design that re-sealing of the vent hole 36 does not occur until after re-sealing of the dispensing port 20. In such an alternate design, it would be desirable to provide an audible and/or tactile reminder that is activated upon re-sealing of the vent hole 36, so that the user will not simply re-close the dust cover 26 and forget to re-seal the vent hole 36, thereby causing the beverage to lose its carbonation.

Figure 3:
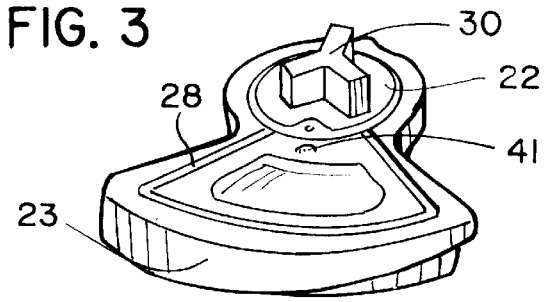
FIG. 3 is a perspective view of the sealing flap of the resealable closure shown in FIG. 1.

Physical interference means are utilized in each embodiment of the present invention to initiate the seal between the sealing flap 22, the sealing gasket 28, and the perimeter of the dispensing port 20. Once the seal is initiated, a build up of internal pressure from gasses inside the beverage container 12 collecting in the head space beneath the lid causes a pressure differential that gradually results in an axial force that tends to enhance the seal between the sealing flap 22, the sealing gasket 28, and the perimeter of the dispensing port 20. To create the initial seal, the source of the physical interference means shown in FIG. 1 takes the form of one or more inwardly-directed annular ribs 44, offset a predetermined distance downwardly from the underside 19 of the lid 18, provided on an inner annular wall extending downwardly from the underside 19 of the lid 18. The predetermined distance for at least one of the ribs 44 is at least slightly less than the combined thickness of the sealing flap 22 and the sealing gasket 28, such that when a distal end 23 of the sealing flap 22 is between at least one of the ribs 44 and the underside 19 of the lid 18, a force fit is created, biasing the sealing flap 22 in a direction toward the underside 19 of the lid 18 and initiating the seal between the sealing flap 22, the sealing gasket 28, and the perimeter of the dispensing port 20. Preferably, the upper surfaces of the ribs 44 are progressively sloped, such that during rotation of the sealing flap 22, the distance between the ribs 44 and the underside 19 of the lid 18 decreases as the sealing flap 22 approaches a position directly beneath the dispensing port 20. The distal end 23 of the sealing flap 22 may also be tapered, as shown in FIG. 3, to facilitate a ramping interaction between the sealing flap 22 and the ribs 44.

Figure 5A:
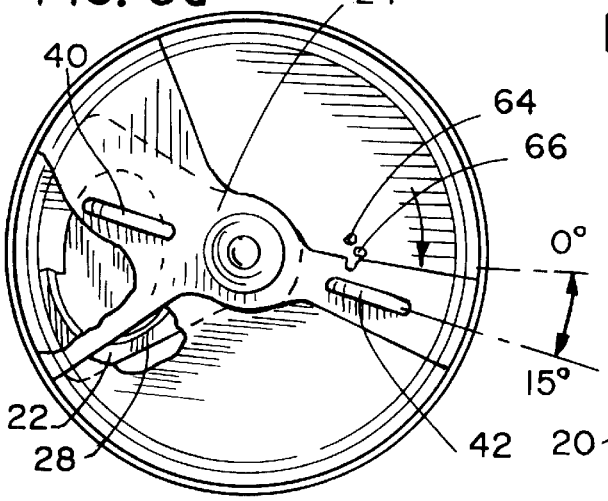
FIG. 5*a* is a top view of the resealable closure shown in FIG. 1, with the external drive means moved to an intermediate position, wherein the vent of the resealable closure is unsealed and the dispensing port of the beverage container is still sealed.
Figure 5B:
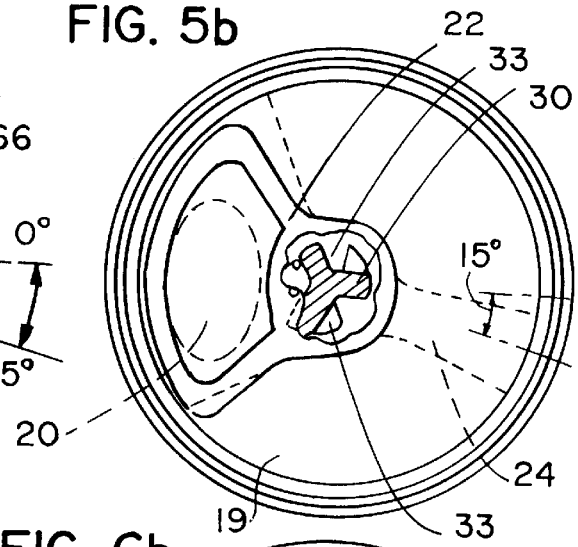
FIG. 5*b* is a bottom view of the resealable closure shown in FIG. 1, showing the resealable closure at the same instant in time as FIG. 5*a*, with the sealing flap still in its initial position.

Advantageously, the present invention makes it unnecessary to overcome high friction between the sealing flap 22 and the ribs 44 throughout the duration of movement of the sealing flap 22 from the position shown in FIG. 5*b* to the position shown in FIG. 6*b*. Once the initial interference that helped form the seal between the sealing flap 22,and the perimeter of the dust cover 20 is overcome, as the dust cover 26 continues to drive the sealing flap 22, the tapered distal end 23 of the sealing flap 22 moves with increasing ease as the distance between the top of the ribs 44 and the underside 19 of the lid increases. Thus, a user need only exert a reasonable amount of force on the tabs 40, 42 of the dust cover 26 to drive the sealing flap 22 to the fully open position shown in FIG. 6*b*.

In order to prevent the dust cover 26 or the sealing flap 22 from cocking out of alignment during this ramping interaction between the sealing flap 22 and the ribs 44 as the sealing flap 22 is opened or closed, it is advantageous to allow the sealing flap 22, which is axially locked to the dust cover 26 by the ribs 35 received in grooves 37 (at least while the external drive means 24 is moving the sealing flap 22), to move vertically with respect to the lid 19. This is accomplished by means of raised buttons 41 provided on the top surface of the sealing flap 22, which ride in curved, sloped raceways 43. A corresponding pair of buttons may be provided on the underside of the dust cover 26, which ride in curved, sloped raceways (not shown) on the upper surface of the lid 18.

Another advantage of the present invention is that, because the force a user needs to exert on the external drive means 24 is relatively small during the initial venting of the internal pressure of the beverage container 12, it is possible to provide a tamper evident feature that a user could easily break upon initial venting. As best shown in FIGS. 4*a*, 5*a*, and 6*a*, the tamper evident feature may take the form of a raised pin 64 provided on the lid 18, securing the external drive means 24 in the fully closed initial position by a breakable membrane 66 near a side edge of the external drive means 24. The breakable membrane 66 is preferably an integral part of the dust cover 26. As the dust cover 26 is moved to the intermediate position to allow venting, the membrane 66 breaks, providing visible evidence that the dust cover 26 of the resealable closure 10 on the beverage container 12 has been manipulated. Preferably, the raised pin also has a mushroomed top (not shown) that will prevent the dust cover from being raised out of rotational engagement with the pin without breaking the membrane. Because the other forces required to move the dust cover easily during venting are small, more force can be devoted to rupturing a breakable membrane thereby resulting in a more easily observable evidence of tampering. Favorably, the pin 64 may also provide a stop to prevent over-rotation of the external drive means 24, so that the back end of the dust cover 26 is not rotated so far as to block the dispensing port 20.

Figure 9:
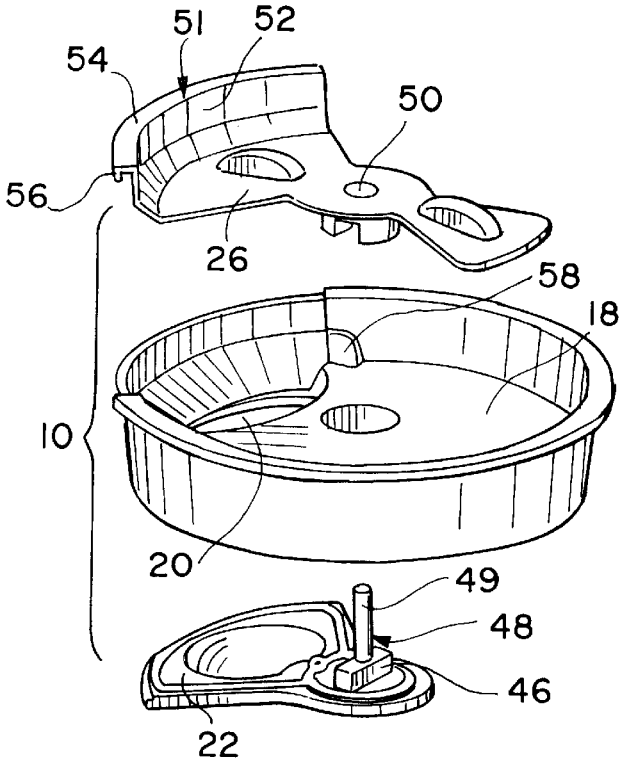
FIG. 9 is an exploded view of a second embodiment of the resealable closure for beverage containers of the present invention.
Figure 8:
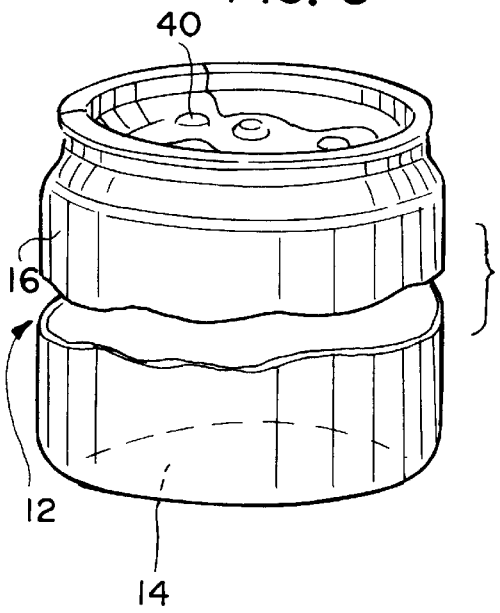
FIG. 8 is a perspective view, broken away, of a beverage container in the form of a metal can, including a resealable closure of the type shown in FIG. 10.
Figure 10:
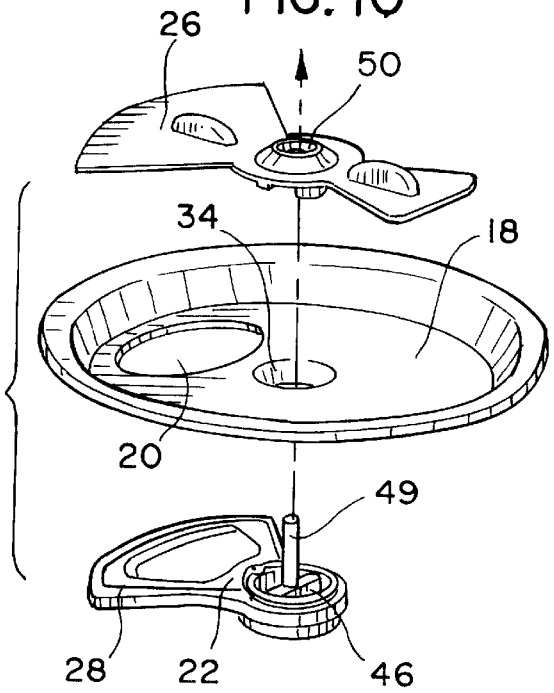
FIG. 10 is an exploded view of a modified version of the second embodiment of the resealable closure for beverage containers of the present invention.
Figure 11:
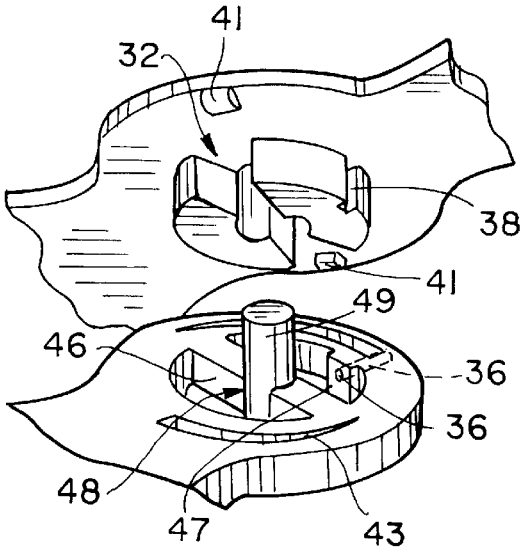
FIG. 11 is an enlarged exploded view of the interconnection between the external drive means and the sealing flap of the resealable closure shown in FIG. 10.

Turning to FIGS. 9–11, a second embodiment of the present invention utilizes a riveted bayonet-type fitting between the external drive means 24 and the sealing flap 22. As in the first embodiment, a dwell period is provided between initial movement of the dust cover 26 and the sealing flap 22, achieved by means of providing a socket 32 that is larger than the horizontal bar 46 in the inverted T-shaped connector member 48 of the sealing flap 22. As best shown in FIG. 10, the stem or post 49 of the inverted T-shaped connector member 48 extends upwardly through the hole 34 provided in the lid 18, and through a post-receiving hole 50 provided in the dust cover 26. The top of the post 49 is then flattened (not shown), to provide a riveted interconnection between the dust cover 26 and the sealing flap 22. Notwithstanding the riveted interconnection, the dust cover 26 can still move relative to the sealing flap 22 during the dwell period, i.e. until one of the walls of the socket 32 contacts one of the sides of the horizontal bar 46. A venting channel 38 selectively communicates with the vent hole 36 provided in the sealing flap 22 once the dust cover 26 reaches the intermediate position, i.e. the position shown in FIG. 5*a*, which vents the internal pressure of the beverage container. At that point, one or more of the walls of the socket 32 comes into contact with one or more of the sides of the horizontal bar 46, whereupon further rotational movement of the dust cover 26 results in corresponding rotation of the sealing flap 22, which opens the dispensing port 20 in the lid 18.

It is recognized that sealing of the vent hole 36 to prevent equalizing the internal and atmospheric pressure in the manner shown in FIGS. 2 requires compression in the axial direction. Because temperature variations and other external conditions such as changes in altitude can cause dramatic changes in pressure differential between the inside of the beverage container 12 and the surrounding atmosphere, there is a possibility that the lid 18 will undergo some fluctuations in axial position, presenting a possibility for leakage of gasses through the vent hole 36 if such fluctuations are sufficient to lift the bottom surface 39 of the projection engaging member 33 away from the top of the vent hole 36. Therefore, a vent hole 36 that is oriented along a side wall, such as in FIG. 11, with a molded-in venting channel 38 provided in the dust cover 26 that comes into communication with the vent hole 36 only upon rotation, is less susceptible to leakage. Preferably, a vent hole gasket 47 is secured to the sealing flap 22, immediately surrounding the vent hole 36, to prevent leakage of gasses or liquids whenever the venting channel 38 is not in communication with the vent hole 36.

Re-sealing of the closure member shown in FIGS. 10–11 is accomplished by moving the dust cover 26 in the opposite direction, which first brings the venting channel 38 out of communication with the vent hole 36, thereby re-closing the vent. Once the dust cover 26 reaches an intermediate position, such that the opposite side of the horizontal bar 46 comes into contact with the another wall of the socket 32, further rotational movement of the dust cover 26 causes the sealing flap 22 to return to its initial position, thereby closing the dispensing port 20. In the second embodiment, the dust cover 26 and the sealing flap 22 are axially locked to one another due to the riveting of the post 49. As in the first embodiment, there is a need to prevent cocking of either the dust cover 26 or the sealing flap 22 during their relative movement. Thus, buttons 41 may be provided on the underside of the dust cover 26, which ride in curved, sloped raceways 43 in the top of the sealing flap 22 as dust cover 26 moves relative to the sealing flap 22.

The second embodiment of the present invention shown in FIG. 9 also addresses concerns regarding contamination of exposed portions of the lid 18. One reason many people prefer bottles to cans is that because individual beverage containers undergo substantial handling between the time of packaging and the time of consumption, there is great opportunity for debris to collect on cans, particularly on the surface of the lid 18 between the dispensing port 20 and the sidewall 16, where the user's mouth touches the beverage container 12. In bottles, however, the cap generally covers the threaded region where the user's mouth would touch, except when the user is drinking. In order to prevent debris from collecting on the surface of the lid 18 in this region of a beverage container, the dust cover 26 of the resealable closure shown in FIG. 9 includes a lip 51, having an inner portion 52 extending up the inner sidewall of the lid 18, an annular top portion 54, and an outer portion 56 that extends down the rim of the lid 18. This lip 51 effectively extends the dust cover 26 over the region of the lid 18 that is typically exposed in conventional cans. Annular top portion 54 is preferably provided with a tapered edge, and the rim of the lid 18 is provided with a complementary leading ramp, to facilitate slight lifting of the inner portion.52 of the lip 51, which enables rotating motion of the dust cover 26.

A stop member 58 in the form of a generally vertical tab may also be provided on the lid 18 in order to define a limit to the travel of the dust cover 26. The stop member 58 in FIG. 9 is shown to the right of the dispensing port 20, so it will be appreciated that the dust cover 26 is moved in the counter-clockwise direction to open the resealable closure 10, whereas the dust cover 26 in the first embodiment shown in FIGS. 1–3 is opened by moving in the clockwise direction. When constructing a sealing flap 22 for use with a dust cover 26 that opens in the counter-clockwise direction, it is desirable to taper the distal end 23 of the sealing flap 22 in the opposite direction to the taper shown in FIG. 3.

Figure 12:
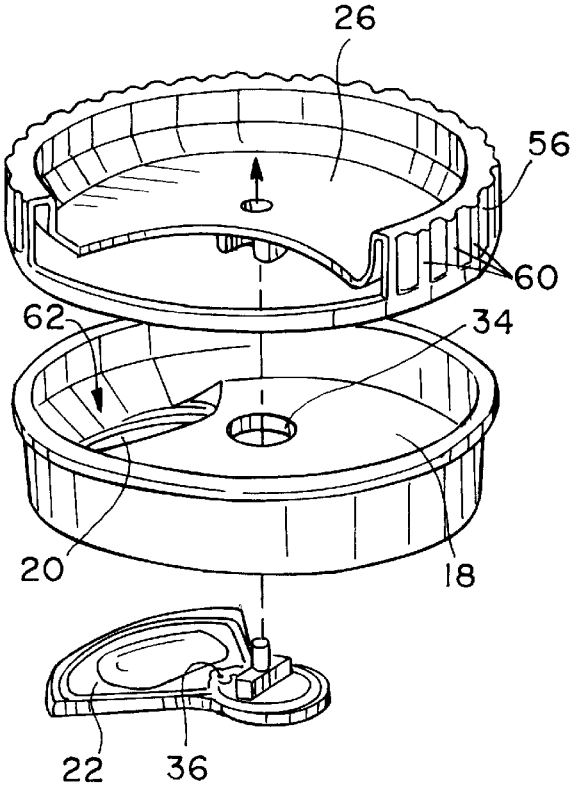
FIG. 12 is an exploded view of a third embodiment of the resealable closure for beverage containers of the present invention.
Figure 14:
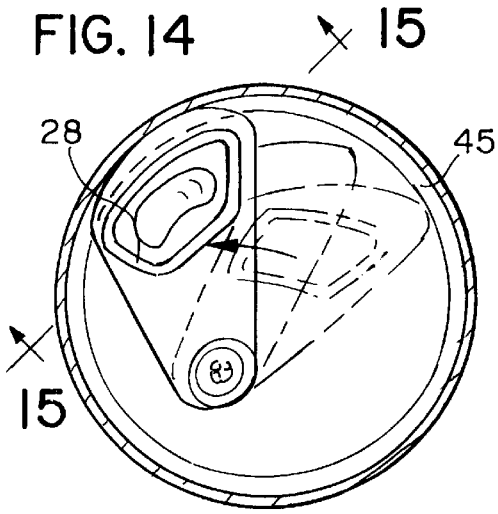
FIG. 14 is a bottom view of the resealable closure in FIG. 13.

In a third embodiment of the resealable closure of the present invention, shown in FIG. 12, the dust cover 26 is extended to cover a broader area of the lid 18, in order to provide even additional sterility to the region of the beverage container 12 touched by a user's mouth. Instead of raised tabs 40, 42 shown in FIG. 1, the outer portion 56 of the dust cover 26 may be provided with a plurality of gripping ribs 60 to facilitate handling and rotation of the dust cover. As in the previous embodiments, the communication between the dust cover 26 and the sealing flap 22 is such that there is a dwell period, during which a vent hole 36 in the sealing flap 22 is exposed by movement of the dust cover 26 to allow venting of the internal pressure of the beverage container prior to opening of the dispensing port 20. The interconnection of the dust cover 26 and the sealing flap 22 in this third embodiment can be similar to the interconnections shown in FIG. 9 or in FIGS. 10 and 11 for the second embodiment. In the third embodiment, the lid 18 may advantageously be provided with a dispensing spout 62 to facilitate drinking the beverage through the dispensing port 20, and to facilitate drainage back into the beverage container 12 through the dispensing port 20 of excess beverage that may collect on the lid 18. Such a dispensing spout may also be provided in a resealable closure of the second embodiment, as shown in FIG. 9. It will be appreciated that in both the second and third embodiments, the manner of providing the initial mechanical interference necessary to initiate the seal between the sealing flap 22, the sealing gasket 28, and the perimeter of the dispensing port 20 may be similar to the ribs 44 shown in FIG. 1, or may take other forms as explained in greater detail below.

Figure 13:
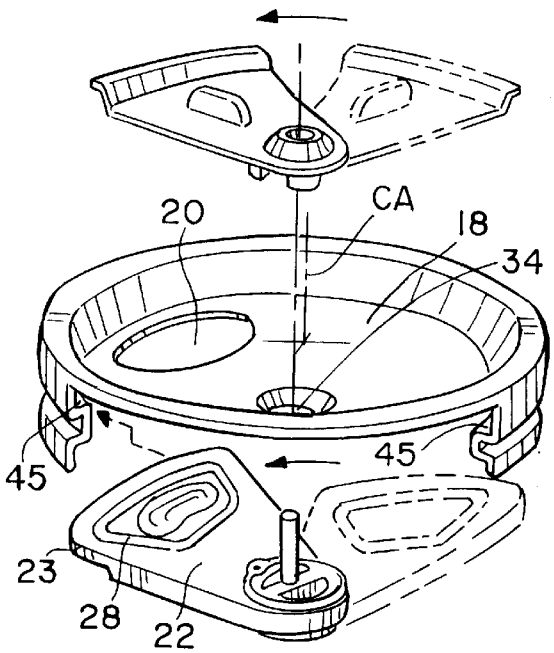
FIG. 13 is an exploded view of a fourth embodiment of the resealable closure for beverage containers of the present invention.
Figure 15:
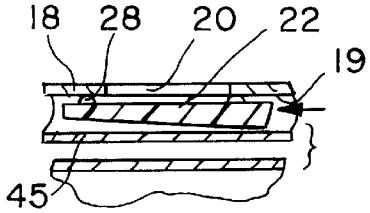
FIG. 15 is a cross-sectional view taken along lines 15—15 of FIG. 14.
Figure 20:
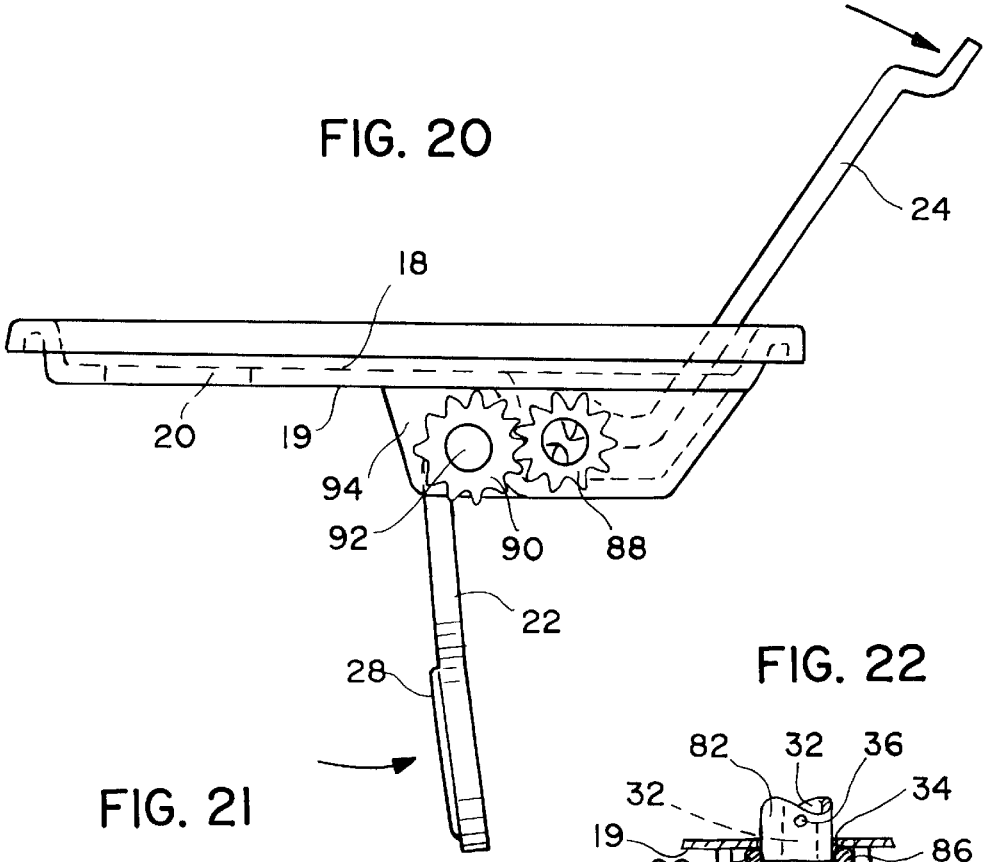
FIG. 20 is a left side view of the resealable closure for beverage containers shown in FIG. 17, with the external drive means moved to a final position, wherein the vent of the resealable closure is unsealed and the dispensing port of the beverage container is unsealed.

As shown in FIGS. 13–16, the means of creating physical interference to initiate a seal between the sealing flap 22, the sealing gasket 28 and the perimeter of the dispensing port 20 may instead take the form of an annular shelf 45 extending the entire circumference of the beverage container 12, formed either as an integral part of the resealable closure, as shown in FIG. 13, or formed in the sidewall 16 of a can. By providing a predetermined distance of less than the combined thickness of the sealing flap 22 and the sealing gasket 28 between the underside 19 of the lid 18 and such a circumferential annular shelf 45, a force fit is created when the distal end 23 of the sealing flap 22 is between the shelf 45 and the underside 19 of the lid 18, helping to achieve and maintain a seal of the dispensing port 20. In this embodiment of the present invention, one avoids having to overcome frictional forces caused by the force fit during the entire motion of the sealing flap 22 because the path of the distal end 23 of the sealing flap 22 advantageously follows a different radius of curvature than the circumference of the lid 18, as can be appreciated with reference to FIG. 14. This could be achieved, for example, by providing the axis of the hole 34 through which the external drive means 24 communicates with the sealing flap 22 at a different location than the central axis CA of the lid 18. The distal end 23 of the sealing flap 22 is preferably tapered, as best seen in FIG. 15, so that the contact between the sealing flap 22 and the underside 19 of the lid 18 gradually increases as the sealing flap 22 approaches a position directly beneath the dispensing port 20.

By imparting a fillet or chamfered taper in the radial direction to the shelf 45 as shown in FIG. 13, which can be accomplished during manufacture of the lid 18, and imparting a complementary chamfered or azimuthal taper to the distal end 23 of the sealing flap 22, a tight seal is achieved between the sealing flap 22, the sealing gasket 28, and the perimeter of the dispensing port 20 on the underside 19 of the lid 18, as seen in FIG. 15. The eccentric movement of the sealing flap 22, during rotation about the location separate from the central axis CA of the lid 18, includes a radial component to motion of the sealing flap 22 relative to the central axis CA, the side wall 16, and the shelf 45. Those of ordinary skill in the art will recognize that in order to accomplish the eccentric movement of the sealing flap 22 in a way that results in a flush, synchronized contact of the sealing flap 22 and the portion of the shelf 45 underneath the dispensing port, the sealing flap 22 must have an asymmetrical perimeter.

It will also be recognized by those of ordinary skill in the art that the physical interference means which biases the sealing flap 22 in a direction toward the underside 19 of the lid 18, and thereby initiates the seal between the sealing flap 22, the gasket 23, and the perimeter of the dispensing port 20, need not be located along the perimeter of the lid 18. Instead, it could take the form, for example, of a radially-oriented shelf (not shown), generally L-shaped in cross-section, that extends downwardly from the underside 19 of the lid 18 along one side of the dispensing port 20. Such an L-shaped radially oriented shelf would be similar to the stop portions described on the top of the lid in co-owned U.S. patent application Ser No. 08/953,067. All that is necessary is for at least a portion of the sealing flap 22 to engage a physical obstacle during movement of the sealing flap 22 to a position directly beneath the dispensing port 20, such that the sealing flap 22 is biased in a direction toward the underside 19 of the lid 18, which initiates the seal between the sealing flap 22, the gasket 28, and the perimeter of the dispensing port 20. As noted above, a particular advantage of the present invention is that this seal is enhanced by the differential between the internal pressure, resulting from, e.g., carbonated beverages, and atmospheric pressure.

As also stated above, the principles of the present invention can be applied even to resealable closures in which either or both of the external drive means 24 and sealing flap 22 move outside of planes generally parallel to the lid 18. For example in FIGS. 17–20, a fifth embodiment of the resealable closure of the present invention is shown in which both the dust cover 26 and the sealing flap 22 flip outside of planes that are parallel to the lid 18. Advantageously, this embodiment also includes an initial slack during which venting takes place as a result of movement of the dust cover 26 prior to initial movement of the sealing flap 22. The external drive means 24 pivots about an axis just below the underside 19 of the lid 18. The pivot axis at a rear end of the external drive means 24 sits in a well 68 provided in the lid 18. The well 68 includes a pair of side walls 70, 72, a front wall 74 a rear wall 76, and a floor 78. In order to minimize the sealing required to prevent leakage, interaction between the external drive means 24 and the sealing flap 22 takes place outside of the well 68, i.e. within the beverage container 12.

As best seen in FIG. 19, the venting of the resealable closure 10 is achieved with an axle 80 at the rear end of the dust cover 26, inside the well 68. The axle 80 includes a venting channel 38, which leads to the outside of the axle 80, thereby venting any gases in the channel 38. The venting channel 38 selectively rotatably engages a vent hole 36 provided in a rotatable drive gear shaft 82. Because the vent hole 36 is always in communication with a hollow central gas passageway 84 within the drive gear shaft 82, the internal pressure equalizes with the surrounding atmospheric pressure as soon as the venting channel 38 communicates with the vent hole 36. This takes place during the initial dwell period, i.e. before the axle 80 actuates the drive gear shaft 82.

Just as the vent hole gasket 47 in the embodiment shown in FIG. 11 is used to seal a vent hole 36 when not in communication with a venting channel 38, a gasket material (not shown) suitable to provide a gas tight seal for the vent hole 36 in the drive gear shaft 82 when the vent hole 36 is not in communication with the venting channel 38, is preferably provided in this embodiment. Such a gasket material could be secured to the drive gear shaft 82 between the exterior of the drive gear shaft 82 (immediately surrounding the vent hole 36) and the interior of the axle 80. Alternatively, one or more annular internal gaskets (not shown) may be provided between the vent hole 36 and the walls 70, 72 of the well, as necessary to seal the vent hole 36.

In order to prevent undesired leakage of beverage through the walls 70, 72 of the well, an annular gasket 86 is preferably provided at the intersection of the drive gear shaft 82 and the side walls 70, 72.

Once the internal and external pressures have generally been equalized by unsealing the vent hole 36, a radial surface in the interior of the axle 80 contacts a radial extension of the drive gear shaft 82, and further flipping movement of the external drive means 24 away from the plane of the lid 18 causes the axle 80 to rotate the drive gear shaft 82 in the same direction. The drive gear shaft 82 is provided with at least one drive gear 88 provided outside one or both side walls 70, 72. The drive gear 88 has been omitted from FIG. 19 for clarity, but can be seen in FIGS. 17, 18 and 20. The drive gear 88 includes a multiplicity of gear teeth that engage complementary teeth in a seal flap gear 90, at least one of which is provided on a separate seal flap gear shaft 92 extending from a projection 94 of the well 68 that extends forwardly the front wall 74 of the well 68. The projection 94 of the well 86 is narrower than the distance between the side walls 70, 72, which allows the seal flap gear shaft 92 to be integral with a rear end of the seal flap 22, in the same manner that the axle 80 is integral with the rear end of the external drive means 24. It is recognized that this slack between the radial surface of the interior of the axle 80 and radial extension of the drive gear shaft 82, which allows venting to occur prior to movement of the sealing flap 22, may alternatively be accomplished by providing sufficient slack in between the drive gear 88 and the sealing flap gear 90.

Movement of the drive gear shaft 82 results in clockwise rotation of the drive gear 88, thereby causing counterclockwise rotation of the seal flap gear 90 and the seal flap gear shaft 92, resulting in the seal flap 22 flipping down and away from the dispensing port 20. Because the dust cover 26 covers the dispensing port 20 until the beverage container 12 reaches the user, the fact that the sealing flap 22 is moving down and into the beverage itself is of little concern to the user, inasmuch as there is only a small chance that debris can contaminate any surface of the sealing flap 22.

As discussed with respect to the previous embodiments, it is necessary to initiate the sealing force to seal the sealing flap 22 and sealing gasket 28 to the perimeter of the dispensing port 20 on the underside 19 of the lid 18. Such an initial sealing force was provided in the previous embodiments, in which the sealing flap 22 rotated in a direction generally parallel to the lid 18, by translating angular motion of the sealing flap 22 into a sealing force generally perpendicular to the perimeter of the dispensing port 20. It is noted that in this fifth embodiment, as well as in subsequent embodiments discussed below, the direction of motion of the sealing flap, at least in the immediate vicinity of the lid 18, is already generally perpendicular to the perimeter of the dispensing port 20. Thus, it is not necessary to utilize initial physical interference means to translate angular motion of the sealing flap 22 into a force in a direction generally perpendicular to the perimeter of the dispensing port. Instead, one need only initially compress the sealing flap in its normal direction of motion toward the perimeter of the dispensing port to achieve the initial sealing force. This may be achieved by applying an initial compressive load to the external drive means 24, which in the present-embodiment results in rotation of the seal flap gear 90 by the drive gear 88 to achieve compression of the sealing flap 22 toward the perimeter of the dispensing port 20. As in all of the previous embodiments, the seal between the sealing flap 22, the sealing gasket 28, and the perimeter of the dispensing port 20 is enhanced by virtue of the forces resulting from the pressure differential biasing the sealing flap 22 toward the perimeter of the dispensing port 20. Once there is a sufficient build up of pressure in the head space of a beverage container to provide such a pressure differential, the sealing force between the sealing flap 22, the sealing gasket 28, and the perimeter of the dispensing port 20 is advantageously sufficiently enhanced to make it unnecessary to continue to apply a compressive force to the external drive means. It will be appreciated that forms of engagement other than interlocking circular gears could be used to convert the rotation of the dust cover 26 into the desired flipping of the sealing flap 22.

Figure 22:
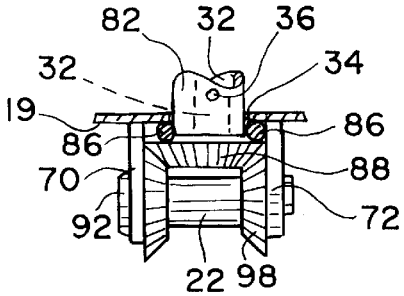
FIG. 22 is a rear plan view of the drive mechanism of the resealable closure of the present invention shown in FIG. 21.
Figure 21:
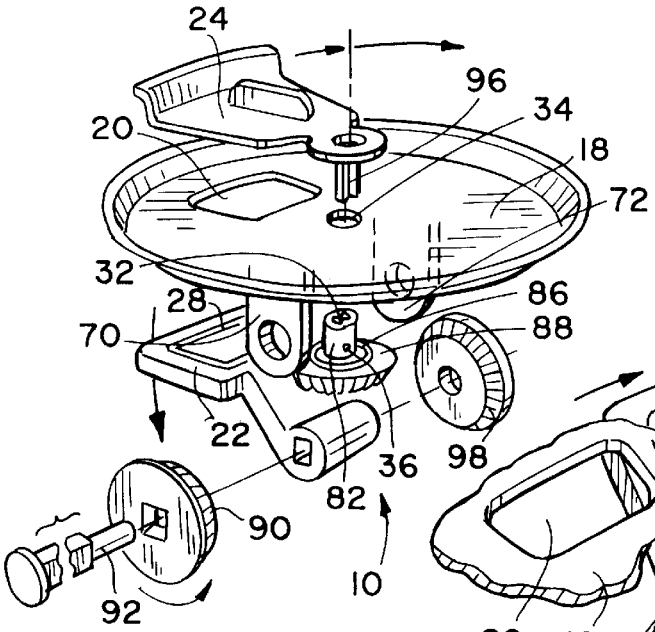
FIG. 21 is an exploded view of a sixth embodiment of the resealable closure of the present invention.

Turning now to FIGS. 21 and 22, a sixth embodiment of the resealable closure 10 of the present invention involves applying the same principles of the invention to a resealable closure 10 in which the external drive means 24 moves in a plane generally parallel to the lid 18, and selectively actuates movement of the sealing flap 22 in a direction outside of a plane generally parallel to the lid 18. The dust cover 24 in this embodiment may be of a style that extends on either side of the central axis of the beverage container, such as the dust cover 26 shown in FIGS. 9–10, but for clarity, FIG. 21 shows a dust cover 26 that only has a single tab 40 for a user to grip to actuate the dust cover 26. As in previous embodiments, an initial dwell period is provided during movement of the dust cover 26 prior to actuation of the sealing flap 22 in order to unseal a vent hole 36. A "bow-tie" connector 96 (named for its shape) projects downwardly from the dust cover 26, and is preferably an integral extension thereof. The bow-tie connector 96 is received in a socket 32 in a drive gear shaft 82. The walls of the socket 32 are spaced so as to provide sufficient slack or clearance for the male portion of the bow-tie connector 96 to not only be received in the socket 32, but also to rotate a short distance, preferably about 15°, in order to unseal the vent hole 36 prior to taking up this slack and moving the drive gear shaft 82.

A beveled drive gear 88 is provided at the bottom end of the drive gear shaft 82, and is provided with an annular gasket 86. At least a portion of the drive gear shaft 82 extends through the hole 34 in the lid 18, so that the annular gasket can be seated against the underside 19 of the lid 18, or at least against the bottom of a collar (not shown) extending downwardly from the hole 34 in the lid 18, to prevent leakage of gasses and liquids.

Once the vent hole 36 is unsealed, the bow-tie connector 96 comes into intimate contact with the walls of the socket 32. Continued rotating motion of the external drive means 24 (in the direction indicated by the arrows in FIG. 21 adjacent the dust cover 26) results in corresponding rotation of the beveled sealing flap gear 90, due to the inter-linkage of the drive gear 88 and sealing flap gear 90 as shown in FIG. 22. The resulting rotation of the sealing flap gear 90 rotates the sealing flap gear shaft 92, which is supported between side walls 70, 72 extending downwardly from the underside 19 of the lid 18. The sealing flap gear shaft 92 is drivingly received in an opening through the sealing flap gear 90. However, the sealing flap gear shaft 92 is only received in a third beveled gear, which is a dummy gear 98, for purposes of supporting that dummy gear 98. Because rotation of the drive gear 88 causes the sealing flap gear 90 and the dummy gear 98 to rotate in different directions, it will be understood that the dummy gear is provided primarily for symmetry and support, rather than function.

The sealing flap gear shaft 92 is also received in (or, alternatively, may be an integral part of) the sealing flap 22. As in the fifth embodiment, the initial physical interference necessary to initiate the sealing force to seal the sealing flap 22 and sealing gasket 28 to the perimeter of the dispensing port 20 on the underside 19 of the lid 18 can be achieved by means of a pre-load of the seal flap gear 90 by the drive gear 88.

Figure 23:
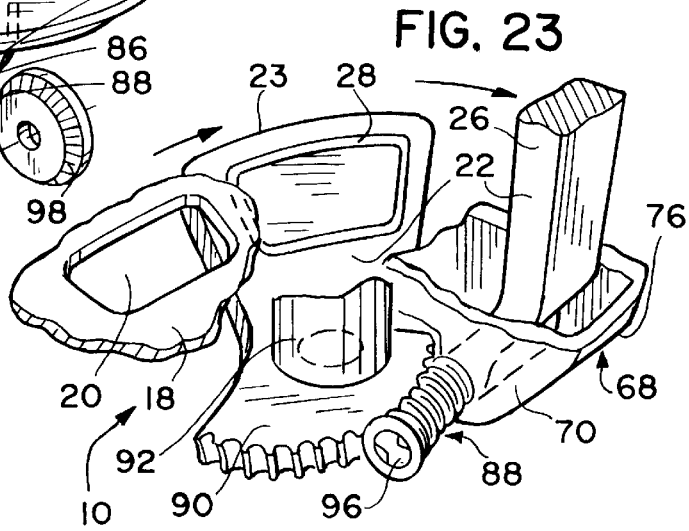
FIG. 23 is a perspective view, broken away, of a seventh embodiment of the resealable closure of the present invention.

In FIG. 23, a seventh embodiment applies the principles of the present invention to a resealable closure 10 in which it is the dust cover 26 that flips outside a plane generally parallel to the lid 18, which, subsequent to pressure equalization by venting of the internal pressure, causes the sealing flap 22 to move by rotation in a direction generally parallel to the lid 18. In this embodiment, the slack during which venting occurs prior to movement of the sealing flap 22 can achieved primarily in the same way as discussed above with regard to the fifth and sixth embodiments, so a detailed explanation thereof is omitted. Subsequent to venting, a worm drive gear 88, provided outside (i.e., on the beverage side) of side wall 70 of a well 68 in the lid 18, rotates, causing rotational movement of a seal flap gear 90 by virtue of a multiplicity of teeth on the seal flap gear 90 riding along the worm gear 88. The seal flap gear 90 is shown in FIG. 23 to be integral with the seal flap 22, and both rotate about a seal flap gear shaft extending downwardly from the underside 19 of the lid 18 to move the seal flap 22 in the direction of the arrow shown in the drawing figure immediately adjacent the preferably tapered distal end 23 of the sealing flap 22.

Because the sealing flap 22 is moving by rotating in a plane generally parallel to the lid 18 in order to unseal the dispensing port 20, the initial physical interference required to initiate the seal between the sealing flap 22, the sealing gasket 28 and the perimeter of the dispensing port 20 on the underside 19 of the lid 18 can be accomplished, for example, by use of the intermittent annular ribs 44 shown in FIG. 1, if the sealing flap travels along a radius of curvature coinciding with that of the sidewall 16 of the beverage container 12. Alternatively, the initial mechanical interference can be accomplished by use of the annular shelf 45 shown in FIGS. 13 and 16, if the sealing flap travels along a different radius of curvature than the radius of curvature of the sidewall 16 of the beverage container 12.

Figure 24:
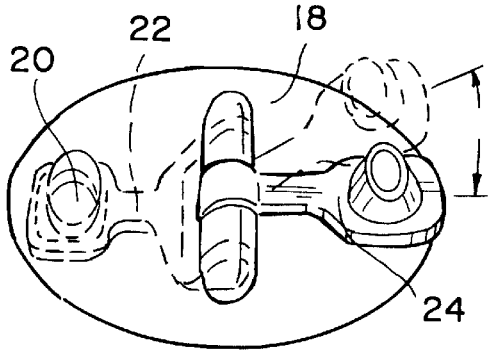
FIG. 24 is a perspective view of an eighth embodiment of the resealable closure of the present invention.
Figure 25:
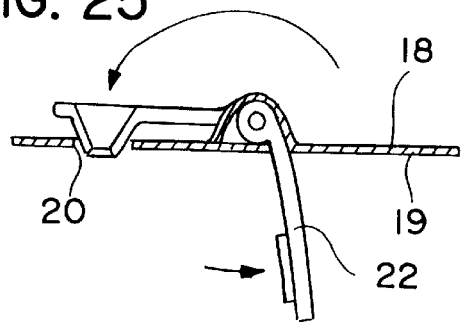
FIG. 25 is a cross-section of the resealable closure for beverage containers shown in FIG. 24.

FIGS. 24 and 25 show an eighth embodiment, wherein the external drive means 24 starts in a position away from the dispensing port 20, such that initially, only the sealing flap 22 prevents debris from entering the beverage container. It is understood that this embodiment may be less desirable, inasmuch as a portion of the sealing flap 22 that is exposed during shipment of the beverage container 12 flips down into the beverage. Because the final position of the external drive means 24 is directly over the dispensing port, the external drive means 24 is provided with its own aperture to facilitate drinking. Again, the initial slack to accommodate venting prior to movement of the sealing flap 22, and the initiation of a seal via initial mechanical interference, can be accomplished using the same principles discussed above for earlier embodiments.

Figure 26:
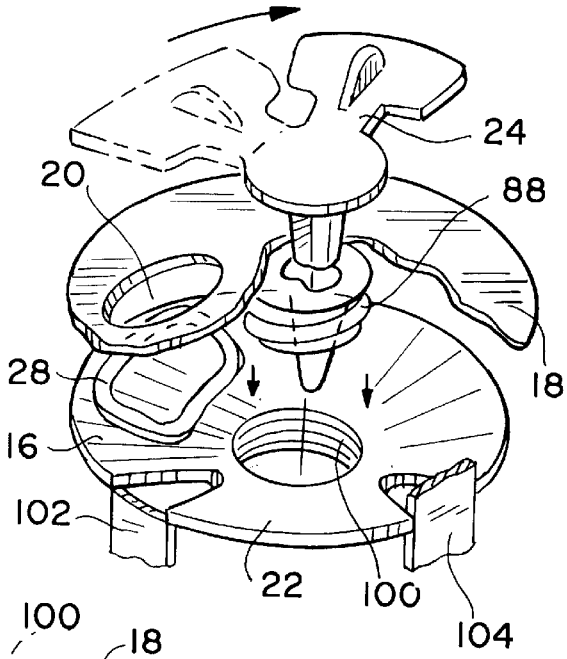
FIG. 26 is an exploded view of a ninth embodiment of the resealable closure of the present invention.
Figure 27:
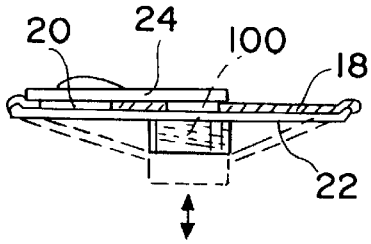
FIG. 27 is a cross-section of the resealable closure for beverage containers shown in FIG. 26.
Figure 28:
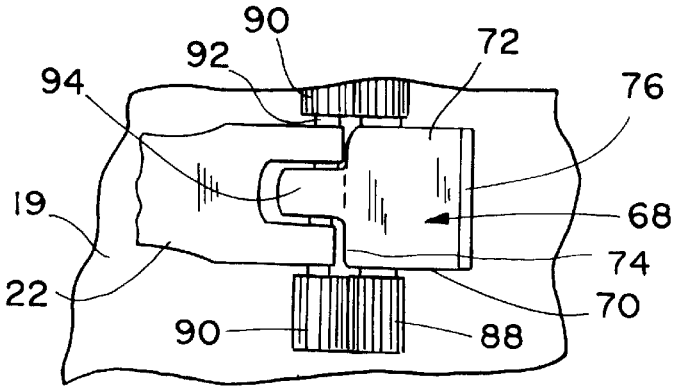
FIG. 28 is a bottom view of the resealable closure for beverage containers shown in FIG. 17, taken along lines 28—28 of FIG. 17.

FIGS. 26 and 27 show a ninth embodiment, in which rotation of the external drive means 24 in a plane generally parallel to the plane of the lid 18, after an initial dwell period to accomplish venting in a manner described above, rotates a drive gear 88, which causes axial movement of the sealing flap 22. The sealing flap 22 is preferably made of a flexible material, and is provided with internal threads 100 so as to axially ride along the drive gear 88 as the drive gear rotates. One or more columns 102, 104 may be provided along the interior of the sidewall 16 of the beverage container 12, so as to constrain movement of the sealing flap 22 in the axial direction. The initial mechanical interference can be accomplished by applying a pre-load, so that as the external drive means 24 returns to a position immediately over the dispensing port 20, the sealing flap 22 and sealing gasket 28 are sealed to the perimeter of the dispensing port 20 on the underside 19 of the lid 18.

It will be appreciated by those of ordinary skill in the art that many variations may be made to the embodiments disclosed herein that are still within the scope of the present invention. For example, while the various embodiments have been described generally with respect to containers for pressurized beverages, it will be understood that the principles of the present invention can be easily applied to resealable closures for vacuum-stored beverage and/or food containers.

We claim:

1. An improved resealable closure in combination with a beverage container having a bottom and a sidewall, and a lid of the resealable closure including a dispensing port through which contents of the beverage container may discharge therefrom, wherein the improvement comprises:

a sealing gasket disposed between an underside of the lid and a sealing flap, said sealing flap being actuated by an external drive means physically communicating with said sealing flap through a hole in the lid, the sealing flap being moveable between a sealed position wherein said sealing flap is located directly under a perimeter of the dispensing port, and an unsealed position wherein the sealing flap is out of alignment with the perimeter of the dispensing port whereby contents may be discharged from the beverage container through the dispensing port, at least a portion of said sealing flap being acted upon by a physical interference means when the sealing flap is in the sealed position said physical interference means biasing said sealing flap toward the underside of the lid to initiate a seal between the sealing flap, the sealing gasket and the perimeter of the dispensing port, a pressure equalization port provided in at least one of the sealing flap and the lid, and said external drive means including a venting channel that selectively communicates with said pressure equalization port to allow internal pressure of the beverage container to equalize with atmospheric pressure.

2. The combination of claim 1, in which said communication between the venting channel and the pressure equalization port precedes movement of said sealing flap from the sealed position toward the unsealed position.

3. A resealable closure in combination with a beverage container having a bottom and a sidewall, comprising:

the resealable closure including a lid having a dispensing port through which contents of the beverage container may discharge from the beverage container;

a seal initiating means comprising an initial biasing force resulting from physical engagement of a first portion of the closure member and one of a portion of the lid and the beverage container, said initial biasing force biasing the first portion of the closure member toward said dispensing port of the lid;

a seal enhancing means comprising a supplemental biasing force resulting from a pressure differential between an internal pressure of the beverage container and atmospheric pressure, said supplemental biasing force biasing the first portion of the resealable closure toward said dispensing port of the lid, whereby the first portion of the resealable closure and the dispensing port are in an initially sealed relationship with one another;

the first portion of the resealable closure being moveable between a sealed position, in which the first portion of the resealable closure and the dispensing port are in the initially sealed relationship, and an unsealed position wherein contents of the beverage container may pass through the dispensing port;

and wherein said initial biasing force dissipates as said first portion of the resealable closure is moved from the sealed position to the unsealed position.

4. The combination of claim 3, further comprising a pressure equalizing port provided in at least one of said first portion of the closure member and the lid, said pressure equalizing port being selectively sealed by a second portion of the closure member.

5. The combination of claim 3, further comprising a sealing gasket disposed between said first portion of the resealable closure and the dispensing port.

6. A resealable closure in combination with a beverage container having a bottom and a sidewall, comprising:

the resealable closure including a lid, the lid including a dispensing port through which fluid may discharge from the container, at least a first portion of said closure member being oriented on an underside of said lid and being moveable by an external drive means between a sealed position, in which said first portion of the resealable closure is initially biased toward a perimeter of the dispensing port by physical interference between the first portion of the resealable closure and one of said lid and said sidewall to thereby initiate a seal of the dispensing port, and an unsealed position away from the dispensing port;

wherein when said first portion of the closure member is in the sealed position, forces from a differential between pressure within the beverage container and surrounding atmospheric pressure bias said first portion of the closure member toward the perimeter of the dispensing port to enhance said seal;

and wherein said physical interference biasing said first portion of the resealable closure toward the perimeter of the dispensing port dissipates as said first portion of the resealable closure moves from the sealed position to the unsealed position.

7. The combination of claim 6, wherein at least one of said first portion of the resealable closure and said lid includes a pressure equalization port to facilitate movement of the first portion of the resealable closure from the sealed position to the unsealed position.

8. The combination of claim 7, further including a second portion of the closure member extending outside the beverage container, said second portion of the closure member being moveable between a first position corresponding to said first portion of the closure member being in the sealed position and the pressure equalization port being in a sealed condition, and an intermediate position wherein said first portion of the closure member is still in the sealed position and said pressure equalization port is in an unsealed condition, whereby internal pressure of the beverage container is vented to an outside of the beverage container prior to movement of the first portion of the resealable closure.

9. The combination of claim 7, wherein said pressure equalization port is initially in a sealed condition, and further including means for unsealing said vent hole prior to movement of said first portion of the resealable closure from the sealed position to the unsealed position.

10. The combination of claim 9, wherein said means for unsealing said pressure equalization port prior to movement of the first portion of the resealable closure from the sealed position to the unsealed position includes providing slack between the external drive means and the first portion of the resealable closure.

11. A method for opening and resealing a pressurized beverage container having a resealable closure thereon, comprising the steps of:

first, unsealing a pressure equalizing port provided in the resealable closure;

next, opening a dispensing port provided in a lid of the resealable closure;

followed by the steps of re-sealing said pressure equalization port;

closing said dispensing port;

wherein in said step of unsealing the pressure equalization port, said pressure equalization port is unsealed by moving an external drive means provided on said lid from a first closed and unvented position in which the dispensing port is closed by a sealing flap provided on an underside of the lid, and a portion of said external drive means is in a sealed relationship with the pressure equalization port, to a second closed and vented position in which said vent opening is unsealed and the dispensing port remains closed by the sealing flap.

12. The method of claim 11, wherein in said step of opening the dispensing port provided in the lid of the container, said dispensing port is opened by said external drive means actuating the sealing flap to move from an initial sealed relationship with the dispensing port, to a position out of the sealed relationship with the dispensing port, until the external drive means reaches a third opened and vented position.

13. The method of claim 12, wherein in said step of re-sealing said pressure equalization port, the pressure equalization port is re-sealed by moving said external drive means to a position in which said external drive means re-seals the pressure equalization port without moving the sealing flap.

14. A resealable closure for beverage containers comprising:

a lid having a dispensing port through which fluid contained in a beverage container may be discharged;

a moveable external drive means provided substantially on top of said lid;

a sealing flap provided on an underside of said lid, said sealing flap being moveable between a sealed position in which the sealing flap is located directly under a perimeter of the dispensing port on the underside of the lid and is in sealed engagement therewith, thereby preventing fluid from passing through the dispensing port, and an unsealed position in which said sealing flap is out of alignment with the perimeter of the dispensing port;

the lid having a hole therein through which said external drive means engages said sealing flap;

a pressure equalization port provided in the sealing flap;

a venting channel provided in the external drive means;

movement of the external drive means bringing the venting channel into communication with the pressure equalization port to thereby vent an internal pressure of a beverage container, with which the resealable closure may be attached, to surrounding atmosphere; and a slack between initiation of movement of the external drive means and initiation of movement of the sealing flap, facilitating communication of the venting channel and the pressure equalization port prior to movement of the sealing flap.

15. The resealable closure of claim 14, said external drive means including a tamper evidence means associated therewith, said tamper evidence means being activated upon initiation of movement of the external drive means.

16. The resealable closure of claim 14, further including seal initiating means in the form of one or more inwardly-directed annular ribs provided on an annular sidewall depending downwardly from the lid, said one or more ribs being positioned a predetermined distance beneath the dispensing port of the lid, said predetermined distance being less than a combined thickness of a distal end of the sealing flap and a sealing gasket interposed between said sealing flap and the underside of the lid, whereby when said sealing flap is in the sealed position, said annular ribs bias the sealing flap toward the dispensing port.

17. The resealable closure of claim 16, wherein each of said at least one annular rib is tapered in a circumferential direction.

18. The resealable closure of claim 17, wherein said distal end of the sealing flap includes a complementary taper in the circumferential direction, whereby said biasing of the sealing flap toward the dispensing port gradually dissipates as the sealing flap moves away from the sealed position.

19. The resealable closure of claim 14, further including seal initiating means in the form of an inwardly-directed annular shelf provided on an annular sidewall depending downwardly from the lid, the annular shelf being positioned a predetermined distance beneath the lid, said predetermined distance being less than a combined thickness of a distal end of the sealing flap and a sealing gasket interposed between said sealing flap and the underside of the lid, whereby when said sealing flap is in the sealed position, said annular shelf biases the sealing flap toward the dispensing port.

20. The resealable closure of claim 19, wherein said sealing flap is rotatable about an axis displaced radially from a central axis of the lid, said sealing flap having a distal end shaped so as to be seated flush against the annular shelf and a circumferential portion of the sidewall beneath the dispensing port when the sealing flap is in the sealed position.

21. The resealable closure of claim 14, in which movement of said external drive means is in a plane generally parallel to the lid.

22. The resealable closure of claim 21, wherein movement of the sealing flap between the sealed position and the unsealed position is in a plane generally parallel to the lid.

23. The resealable closure of claim 21, wherein movement of the sealing flap between the sealed position and the unsealed position is outside a plane generally parallel to the lid.

24. The resealable closure of claim 14, in which movement of said external drive means is outside a plane generally parallel to the lid.

25. The resealable closure of claim 24, wherein movement of the sealing flap between the sealed position and the unsealed position is in a plane generally parallel to the lid.

26. The resealable closure of claim 24, wherein movement of the sealing flap between the sealed position and the unsealed position is outside a plane generally parallel to the lid.

* * * * *

UNITED STATES PATENT AND TRADEMARK OFFICE

CERTIFICATE OF CORRECTION

PATENT NO. : 6,626,314 B1
DATED : September 30, 2003
INVENTOR(S) : Robert J. McHenry et al.

It is certified that error appears in the above-identified patent and that said Letters Patent is hereby corrected as shown below:

Column 17,
Line 18, "position" has been deleted and -- position, -- has been inserted in its place.

Signed and Sealed this

Thirteenth Day of April, 2004

JON W. DUDAS
*Acting Director of the United States Patent and Trademark Office*